US006026872A

United States Patent [19]

Leitinger

[11] Patent Number: 6,026,872

[45] Date of Patent: Feb. 22, 2000

[54] SYSTEM FOR PRODUCING CANTS AND WOOD CHIPS

[75] Inventor: Hans-Peter Leitinger, Preding, Austria

[73] Assignee: Holzindustrie Preding Gesellschaft m.b.H., Preding, Austria

[21] Appl. No.: 09/185,106

[22] Filed: Nov. 3, 1998

[30] Foreign Application Priority Data

| | | | |
|---|---|---|---|
| Nov. 4, 1997 | [AT] | Austria | 688/95 U |
| Jul. 3, 1998 | [EP] | European Pat. Off. | 98890194 |

[51] Int. Cl.[7] ..... B27L 5/02

[52] U.S. Cl. ..... 144/369

[58] Field of Search ..... 144/3.1, 176, 39, 144/367, 369, 373, 374

[56] References Cited

U.S. PATENT DOCUMENTS

| | | | |
|---|---|---|---|
| 3,326,252 | 6/1967 | Pease | 144/3 |
| 3,454,060 | 7/1969 | Wall | 144/118 |
| 3,454,063 | 7/1969 | Mitten | 144/326 |
| 3,635,267 | 1/1972 | Reuter | 144/118 |
| 3,791,430 | 2/1974 | Hood et al. | 144/326 |
| 3,880,215 | 4/1975 | Mallery | 144/39 |
| 4,184,526 | 1/1980 | Hanaya | 144/235 |
| 4,230,163 | 10/1980 | Barton | 144/116 |
| 4,378,035 | 3/1983 | Chisum | 144/1 R |
| 4,519,429 | 5/1985 | Dreese | 144/3 R |
| 4,750,535 | 6/1988 | Wolf | 144/373 |
| 4,834,155 | 5/1989 | Vuollet | 144/176 |
| 4,875,631 | 10/1989 | Bardos | 241/92 |
| 5,298,119 | 3/1994 | Brown | 162/55 |
| 5,394,912 | 3/1995 | Hume | 144/208 |

FOREIGN PATENT DOCUMENTS

| | | |
|---|---|---|
| 355792 | 3/1985 | Austria . |
| 378728 | 9/1985 | Austria . |
| 1955293 | 7/1970 | Germany . |
| 201654 | 8/1983 | Germany . |
| 3906626 | 9/1990 | Germany . |
| 4429793 | 6/1995 | Germany . |
| 4443727 | 6/1995 | Germany . |
| 653284 | 12/1985 | Switzerland . |
| 1159780 | 6/1985 | U.S.S.R. . |
| 1308483 | 5/1987 | U.S.S.R. . |

*Primary Examiner*—Joseph J. Hail, III
*Assistant Examiner*—Dermott J. Cooke
*Attorney, Agent, or Firm*—Herbert Dubno; Andrew Wilford

[57] ABSTRACT

A log is first passed between a pair of coarse chippers to cut material from opposite faces of the log as coarse chips and produce a pair of flat sides. Then the log is passed between a pair of fine chippers to cut material from the flat sides as fine chips. The log is then rotated through about 90° and the rotated log is passed between a second pair of coarse chippers to cut material from opposite faces of the log between the flat sides as coarse chips and producing two more flat sides. Finally the log is passed between a pair of fine chippers to cut material from the two more flat sides as fine chips. The coarse chips are 10 cm and 30 cm long, 1 mm and 5 mm thick, and about 35 mm wide and the fine chips are about 10 cm long, about 0.5 mm thick, and 3 cm wide.

3 Claims, 4 Drawing Sheets

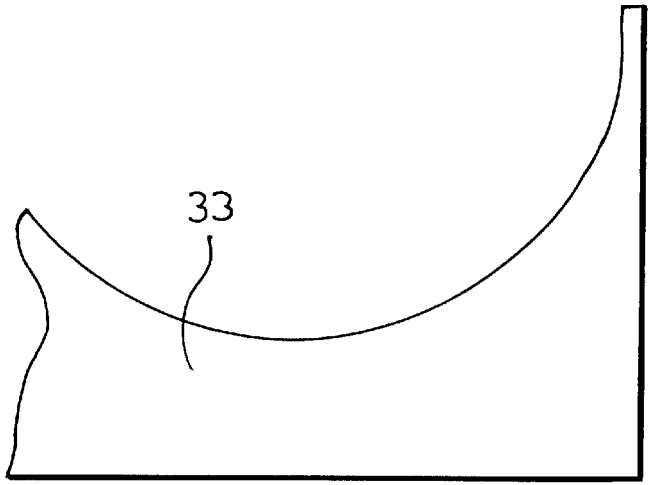
FIG.8
FIG.7
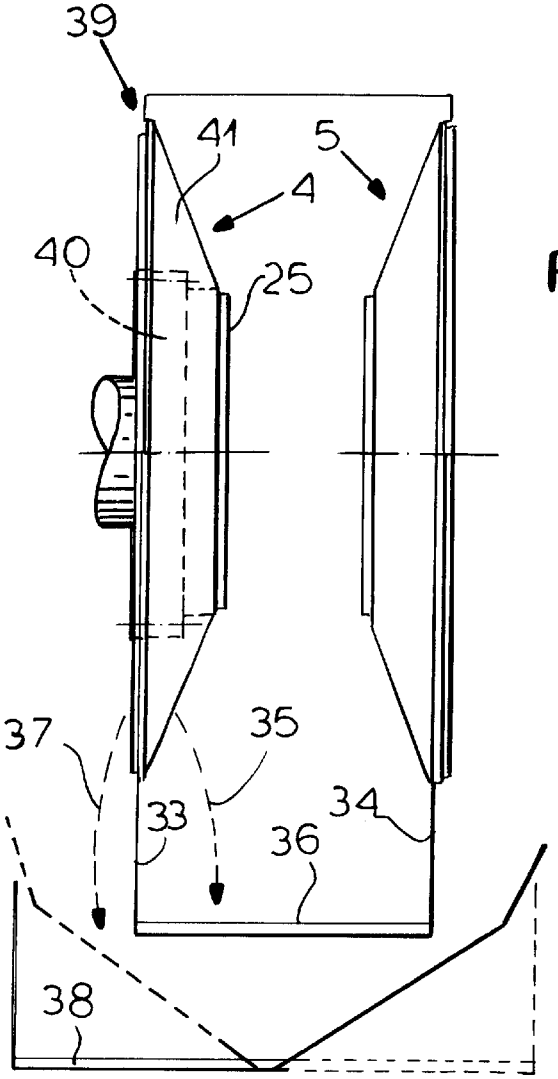

SYSTEM FOR PRODUCING CANTS AND WOOD CHIPS

FIELD OF THE INVENTION

The present invention relates to a system for slabbing logs. More particularly this invention concerns a system for simultaneously slabbing a log into a usable cant and for making production-grade wood chips.

BACKGROUND OF THE INVENTION

A log is typically treated by first slabbing it into a cant. Thus the log is passed in a transport direction parallel to its longitudinal direction through a saw that rips a slab from one of its faces. The slab cut off has an irregular rounded outer surface which say still carry bark and a planar inner face and the log is left with a flat side at which raw inside wood is exposed. The slabbing is continued on all four sides to convert the workpiece into a cant which is a massive timber of rectangular section. This cant can be used as is or cut into dimensional lumber. The sawdust produced by the cutting has little worth as the cellulose fibers are very short.

The slabs cut off the log are of little commercial worth so they are sent to a chipper which transforms them into production-quality wood chips that can be used to make oriented strand board, particle board, and the like.

Such a system is therefore fairly laborious. Three products are eventually produced, the almost worthless sawdust, the useful chips, and the useful cant. Several separate steps are needed at different locations to produce these products.

OBJECTS OF THE INVENTION

It is therefore an object of the present invention to provide an improved system for treating a log.

Another object is the provision of such an improved system for treating a log which overcomes the above-given disad-vantages, that is which transforms a log into chips and a cant, with minimal production of sawdust, in a simple and economical process.

A further object is an improved method of and apparatus for thus treating a log.

SUMMARY OF THE INVENTION

A log is first passed according to the invention between a pair of coarse chippers to cut material from opposite faces of the log as coarse chips and produce a pair of flat sides. Then the log is passed between a pair of fine chippers to cut material from the flat sides as fine chips. The log is then rotated through about 90° and the rotated log is passed between a second pair of coarse chippers to cut material from opposite faces of the log between the flat sides as coarse chips and producing two more flat sides. Finally the log is passed between a pair of fine chippers to cut material from the two more flat sides as fine chips.

Thus this system reduces the starting workpiece to chips and a cant in essentially two simple steps, producing production grade coarse chips and production-grade fine chips and virtually no sawdust. The log is quickly reduced to a cant with clean almost planed surfaces produced by the fine chippers. There is no sawing with production of virtually useless sawdust, and no need to transport the slabs to a chipper. The chips can be dried and pressed into oriented-strand board, chipboard, fiberboard, flakeboard, or the like.

According to the invention the flat sides produced by the coarse chippers are longitudinally scored prior to passing the log between the fine chippers. The coarse chips are 10 cm and 30 cm long, 1 mm and 5 mm thick, and about 35 mm wide and the fine chips are about 10 cm long, about 0.5 mm thick, and 3 cm wide. A preferred coarse chip is 16 cm long, 2 mm thick, and 25 mm wide.

The log-treating apparatus in accordance with the invention has a pair of coarse chipper disks each having a frustoconical surface provided with a spiral row of blades having cutting edges between 10 cm and 30 cm long and spaced apart by between 1 mm and 5 mm. Rollers pass a log in a transport direction between the coarse chipper disks to cut material from opposite faces of the log as coarse chips and produce a pair of flat sides on the log. A pair of fine chipper disks downstream from the coarse chippers each have a frustoconical surface provided with a spiral row of blades having cutting edges between 4 cm and 12 cm long spaced apart by between 0.4 mm and 1 mm. Further rollers pass the log in the direction between the fine chipper disks and thereby cut material from the flat sides as fine chips. Furthermore in accordance with the invention means is provided downstream of the fine chipper disks for rotating the log through about 90° and a second pair of coarse chipper disks like the first pair of coarse chipper disks cuts material from opposite faces of the log between the flat sides as coarse chips and produces a second pair of flat sides on the log. Similarly, a second pair of fine chipper disks downstream from the second pair of coarse chipper disks and identical to the first pair of fine chipper disks cut material from the second pair of flat sides as fine chips to form a rectangular-section cant of the log.

Of course instead of turning the log the second pairs of disks could be set at 90° to the first pairs so the log is fed straight through, but this system leads to difficulties in chip collection. Either way the log has a predetermined length and the chippers are spaced from each other in the direction by spacings greater than the log length.

Each disk according to the invention is formed of an outer frustoconical ring carrying the respective blades and rotatably driven about an axis and a center flat disk normally biased against the log and not driven about the axis. Means is provided for pressing the center disk into the log. In addition each blade has an end provided with a respective scoring blade.

Furthermore in accordance with the invention means is provided for scoring the flat sides of the log parallel to the direction downstream of the coarse chipper disks and upstream of the fine chipper disks. This means can include a plurality of cutter disks lying in planes parallel to each other and to the direction. The disks having edges engaged in the respective flat sides to a depth of between 5 mm and 20 mm. The disks can simply be pushed into the wood or can have toothed edges and be driven to actually saw shallow kerfs in the flat log faces. Such scoring ensures that the chips subsequently from the log will have square edges and be of very uniform width.

Separate conveyors are used to separately transport the fine and coarse chips away from the respective chippers. The disks are formed adjacent each blade with a throughgoing hole so that the chips cut from the log by the blade pass through the holes. Thus in accordance with the invention means is provided for catching particles and dust from between the disks and for carrying the caught particles and dust away separate from the chips. This means includes shields fitted around the disks.

BRIEF DESCRIPTION OF THE DRAWING

The above and other objects, features, and advantages will become more readily apparent from the following description, reference being mato the accompanying drawing in which:

FIG. 7 is an end view of a chipping/slabbing unit in accordance with the invention; and FIG. 8 is a side view of a shield plate for the unit of FIG. 7.

SPECIFIC DESCRIPTION

Figure 1:
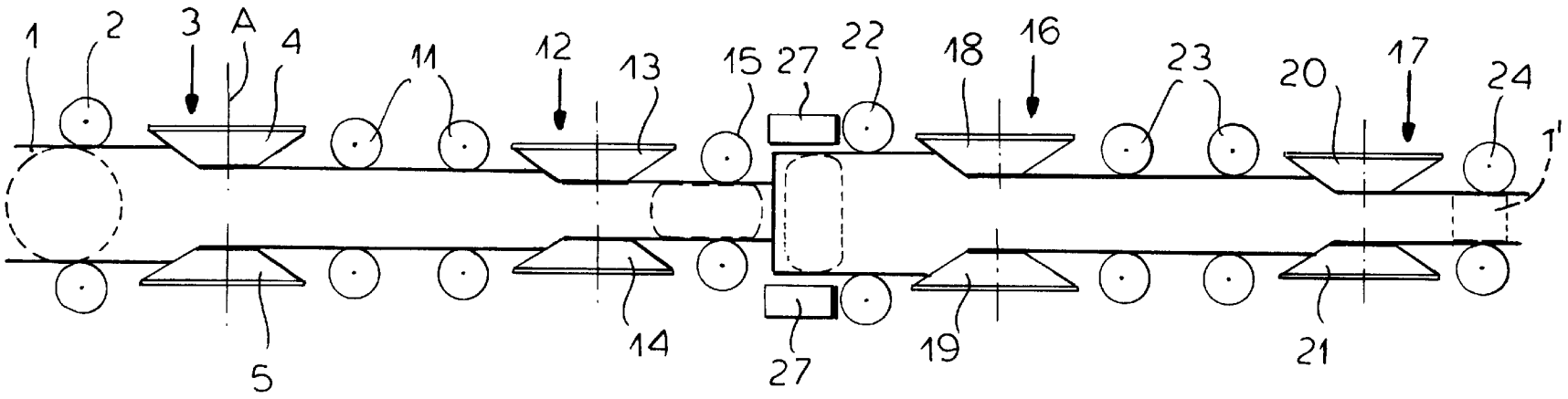
FIG. 1 is a partly diagrammatic top view of a system according to the invention.
Figure 3:
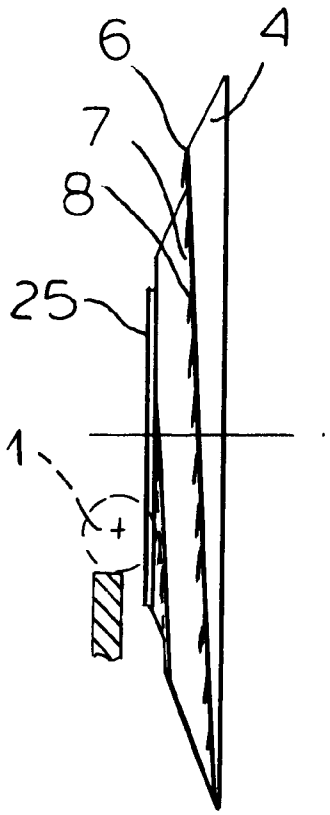
FIG. 3 is a side view of the disk of FIG. 2.

As seen in FIG. 1 a round wooden workpiece 1, normally a log, is transformed into a square-section cant 1' by passage through a first slabber/chipper 3 and a second slabber/chipper 12 that act on opposite sides of the log 1 to produce flat parallel faces, and then a third slabber/chipper 16 and a fourth slabber/chipper 17 that act on the sides perpendicular thereto to produce the finished cant. Between the second and third stage the workpiece is normally turned through 90° by a pair of grippers shown at 27. Rollers 2 push the log 2 into the first slabber/chipper 3 and rollers 11 hold it between this unit 3 and the second slabber/chipper 12 from which the workpiece is pulled by driven guide rollers 15. Rollers 22 push the workpiece into the third slabber/chipper and rollers 23 hold it between this unit 16 and the fourth slabber/chipper 17 from which the finished cant 1' is pulled by more driven guide rollers 24.

Figure 2:
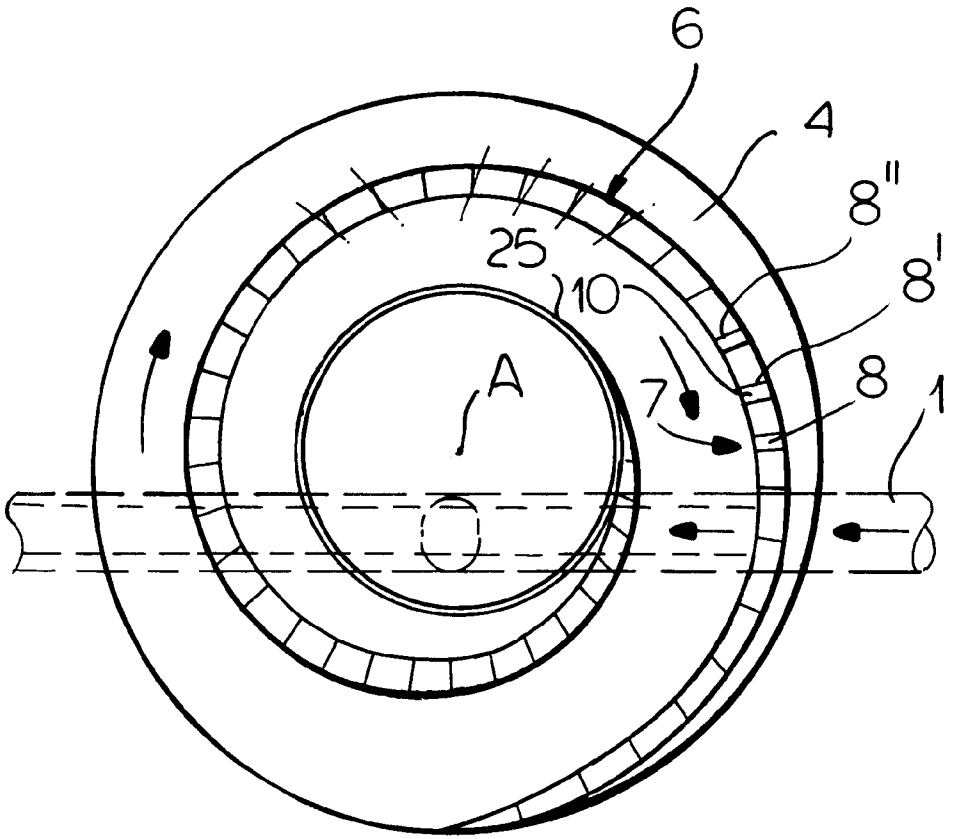
FIG. 2 is an end view of a cutter disk in accordance with the invention.

The first slabber/chipper 3 is formed of two identical generally frustoconical disks 4 and 5 rotated about a common axis A. As shown in FIG. 2 the disk 4 is provided on its frustoconical surface with a spiral row 6 of blades 7 of which three successive cutting edges are indicated at 8, 8', and 8". These edges 8, 8', and 8" all extend generally radially of the respective axis A or at most at an angle of up to 10° thereto and are spaced behind one another in the row 6 by a distance of between 1 mm and 5 mm. The advance rate of the workpiece 1 and the rotation rate of the disk 4 is such that it produces coarse chips between 10 cm and 30 cm long, 1 mm and 5 mm thick, and about 35 mm wide. The length and thickness of the chips are determined directly by the cutting edges 8 of the blades 7. The width of the chips is determined by the shape of the blades 7 and of the chip movement relative to a curved guide surface 9 formed adjacent each cutting edge 8 in an adjacent throughgoing hole 10 in the actual disk 4. The curvature of the surface 9 is such that the chips, which are being cut mainly across the grain, break apart when about 30 mm wide.

The second slabber/chipper 12 is constructed to produce smaller chips. It has cutting edges 8 some 5 cm to 12 cm long offset on the respective disks 13 and 14 by 0.4 mm to 1 mm. This produces a standard chip having a length of about 10 cm, a thickness of 0.5 mm, and a width of 3 cm.

The third slabber/chipper 16 is constructed identically to the first unit 3 so as to produce coarse chips, and the fourth slabber/chipper 17 is constructed identically to the second unit 12 to produce fine chips. The finished cant 1' thus has smooth faces and is suitable for use as is or sawing into dimensional lumber.

The spacing in transport direction between succeeding slabbing/chipping units 3, 13, 16, and 17 and their respective feed rollers 2, 11, 15, 22, 23, and 24 is greater than the maximum long length, about 4 m. This is particularly important between the stages 16 and 17 as it ensures that each unit 16 and 17 can work at an optimum speed, producing a very smooth finished product that is perfectly straight, that is whose side faces are planar. To this end each disk 4, 5, 13, 14, 18, 19, 20, and 21 has a circular and planar center disk 25 that is not driven and that is pressed some 0.1 mm into the respective face of the workpiece, holding it in perfect position. In addition score blades 26 can be provided each on one end of the cutting edges 8 to define an exact sharp-edge flat chip length by scoring the wood perpendicular to the edge so that the cut chip falls free.

Figure 5:
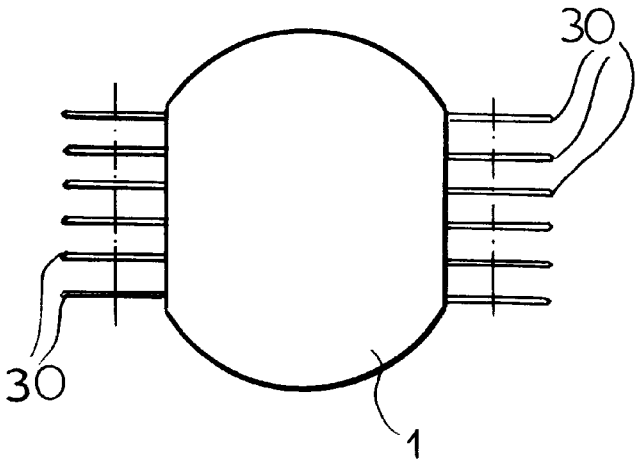
FIG. 5 is a largely schematic view of a part of the system of the invention.
Figure 6:
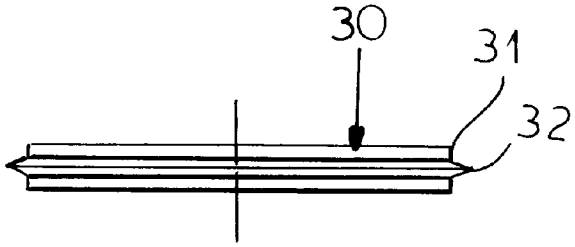
FIG. 6 is a top view of a single scoring disk of the FIG. 5 structure.
Figure 4:
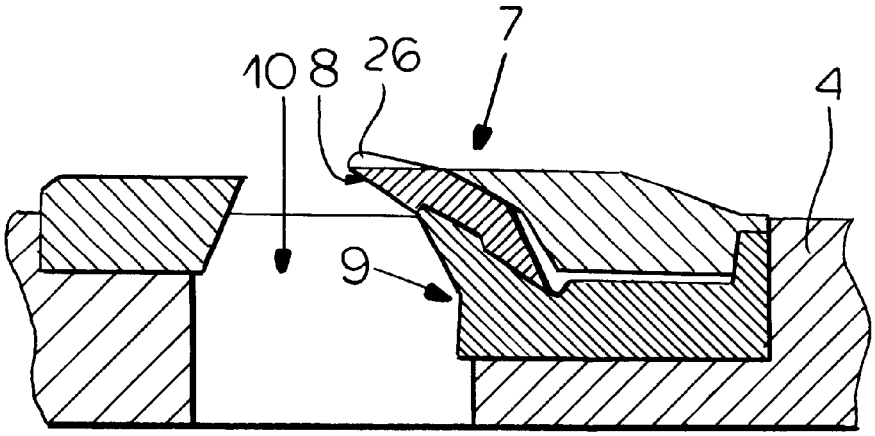
FIG. 4 is a large-scale sectional view of a detail of the disk.

FIG. 5 shows how after the primary slabbing effected by the units 3 and 16 the planar faces of the workpiece 1 can be scored by cutters 30 each formed as shown in FIG. 6 of a pair of circular disks 31 with cylindrical outer surfaces flanking a slightly larger center disk 32 with a sharp outer edge. The differences in diameter between the two disks 31 and 32 is such that when they are pressed against the workpiece they score or groove it to a depth equal to the desired chip thickness, here about 0.5 mm. Thus as the blades 8 move crosswise across the workpiece 1 perpendicular to the grain, they will cut out chips of width exactly equal to the spacing between adjacent cutters 30. Alternately the cutters 30 could be driven circular-saw blades provided with a depth-control system to limit their depth of cut to 5 mm to 10 mm.

FIGS. 7 and 8 show how each disk 4 and 5 has a frustoconical and annular outer ring 41 that is carried on a driven hub 40, that carries the here unillustrated blades 7, and that surrounds the nonrotating center disk 25. Between the disks 4 and 5 is a particle catchment formed by a pair of side walls 33 and 34 having part-circular cutouts shaped to closely surround the disks 4 and 5 and a belt 36 that carries away sawdust or the like falling as shown by arrow 35. Another shield 39 above the two disks 4 and 5 serves to confine any dust generated. A further catchment 38 is provided for chips that go through the disks 4 and 5 and fall as indicated by arrow 37 onto another conveyor belt 38.

Thus the tiny chips and particles, basically sawdust, collected by the belt 36 are kept separate from the large chips collected on the belt 38, which latter are ideal for construction of oriented-strand board or the like.

The original log 1 is transformed by the system of this invention into three main products: a finished cant, a mass of coarse wood chips, and a mass of fine wood chips. Any sawdust generated is kept separate from the production-quality chips. To ensure that the wood chips are of the highest quality, the workpiece 1 can be debarked before passing through the first chipper/slabber 3.

I claim:

1. A method of treating a log, the method comprising the steps of sequentially:

passing the log longitudinally parallel to its grain between a first pair of coarse chippers;

at each of the coarse chippers displacing a succession of cutting edges crosswise across the log with each cutting edge extending generally parallel to the log's grain while in contact with the log and thereby cutting material from opposite faces of the log as coarse long-grain chips and producing a pair of flat sides;

passing the log between a first pair of fine chippers;

at each of the fine chippers displacing a succession of cutting edges crosswise across the log with each fine-chipper cutting edge extending generally parallel to the log's grain while in contact with the log and thereby cutting material from the flat sides as fine long-grain chips;

rotating the log through about 90°;

passing the rotated log between a second pair of coarse chippers;

at each of the coarse chippers of the second pair displacing a succession of cutting edges crosswise across the log with each fine-chipper cutting edge extending generally parallel to the log's grain while in contact with the log and thereby cutting material from opposite faces of the log between the flat sides as coarse long-grain chips and producing two more flat sides; and passing the log between a second pair of fine chippers and;

at each of the fine chippers of the second pair displacing a succession of cutting edges crosswise across the log with each fine-chipper cutting edae extending generally parallel to the log's grain while in contact with the log thereby cutting material from the two more flat sides as fine long-grain chips.

2. The method defined in claim 1, further comprising the step of longitudinally scoring the flat sides produced by the coarse chippers prior to passing the log between the fine chippers.

3. The method defined in claim 1 wherein the coarse chips are 10 cm and 30 cm long, 1 mm and 5 mm thick, and about 35 mm wide and the fine chips are about 10 cm long, about 0.5 mm thick, and 3 cm wide.

* * * * *